United States Patent [19]

Whiteford

[11] 4,372,361

[45] Feb. 8, 1983

[54] MULTI-PURPOSE TURNING TOOL

[76] Inventor: Carl Whiteford, 3 High Point Rd., Westport, Conn. 06880

[21] Appl. No.: 151,368

[22] Filed: May 19, 1980

[51] Int. Cl.[3] ..... B25G 1/00

[52] U.S. Cl. ..... 145/61 R; 145/61 C; 145/61 EA; 145/62

[58] Field of Search ..... 145/61 R, 61 A, 61 B, 145/61 C, 61 D, 61 E, 61 EA, 61 G, 61 J, 61 L, 62, 63; 74/551.1, 543; 16/111 R, 111 A

[56] References Cited

U.S. PATENT DOCUMENTS

| | | | |
|---|---|---|---|
| 3,189,069 | 6/1965 | Stowell | 74/543 |
| 4,036,085 | 7/1977 | Sjostrand et al. | 81/464 |
| 4,093,008 | 6/1978 | Martin | 145/61 EA |
| 4,210,185 | 7/1980 | Acevedo | 145/61 R |
| 4,235,269 | 11/1980 | Kraus | 145/62 |

*Primary Examiner*—James L. Jones, Jr.

*Attorney, Agent, or Firm*—Martin D. Wittstein

[57] ABSTRACT

A novel screwdriver is disclosed which incorporates both the features of a directionally oriented hand grip for achieving greater turning force and storage pockets for holding a plurality of interchangeable tool bits. The handle portion has an outer covering of resilient material with angled fingers which provide a high gripping force when the handle is turned against the direction of the angled fingers. Also both ends of the handle are provided with pockets for holding different turning tools which can be inserted into a shank attached to the handle.

8 Claims, 10 Drawing Figures

MULTI-PURPOSE TURNING TOOL

BACKGROUND OF THE INVENTION

One of the most familiar and frequently used hand tools is the screwdriver, a tool used for turning a variety of fastening devices such as different types of screws, bolts, nuts, etc.

Conventional screwdrivers typically consist of merely a handle adapted to be encircled by the fingers and palm of a user for gripping and rotating the screwdriver, and a shank connected to the handle for rotation therewith, the shank having a specifically shaped free end for engaging with a specifically shaped fastening device for turning the latter. Since there is a large variety of fastening devices available, for example, slot head screws, phillips head screws, hexagonal set screws, hexagonal head screws and various shaped nuts, as well as various sizes of each of the above, it is apparent that a large number of separate tools must be maintained on hand by a user in order for him to have the capability of installing or removing any one of the above mentioned fastening devices, as well as others not mentioned above, that listing being merely exemplary. For example, it would typically be necessary for a worker to have several sizes each of slot head screw drivers, phillips head screwdrivers, nut drivers, allen wrenches, etc., in order to be able to use any of these fastening devices at will. Obviously, such a collection of separate hand tools presents the problems of the expense incurred in obtaining them as well as the storage and carrying capability to have these tools available when and where they are needed.

Another problem frequently encountered with hand tools for turning fastening devices such as the tools mentioned above is that of the difficulty in applying sufficient force to the tool to do the job for which it is designed. This problem is particularly bothersome in the larger sizes of such tools, for example screwdrivers having shanks four to six inches long and approximately one quarter wide in diameter. It is not uncommon that such a screwdriver can withstand far more torque than can be applied to it by the users hand on the handle provided, either because the user's hand slips or the handle for lack of a proper gripping surface or because the gripping surface is poorly designed and causes pain when high torque is applied to it. This problem is compounded by the necessity, particularly in large turning tools, if applying a high longitudinal force to the tool as well as a high torque in order to keep the working end of the tool in proper engagement with the fastening device when the latter is presenting high resistance to turning, such as when inserting a screw into wood without first drilling a pilot hole, or removing a machine screw which has become rusted in place. Since the handles of conventional turning tools are generally cylindrical, it is difficult to apply a high longitudinal force simultaneously with a high torque without experiencing either loss of gripping capability, or pain to the hand or wrist, or both. It is especially hard on the wrist to grasp a conventional screwdriver handle and exert a high torque even with a good gripping surface while utilizing the other hand to push on the screwdriver to apply the longitudinal force required to keep the working end of the screwdriver in engagement with the fastening device.

Several attempts have been made to solve both of the above mentioned problems. While these attempts have met with some degree of success, they have not satisfactorily solved both problems. For example, screwdrivers have been made with interchangeable tool bits which removably attach to a single shank, so that it is not necessary to have a separate tool for all of the difficult types and sizes of fastening devices. It is, however, frequently difficult to insert and remove a tool bit with the standard C-ring or ball detent retaining means usually provided. Some have included storage facilities, such as hollow handles for storing a plurality of tool bits, but these have not been conveniently designed. Attempts have also been made to improve the gripping capability of screwdriver handles by providing various forms of directionally oriented ribs on the surface of the handle so that a greater gripping force can be exerted in one direction than in the other. In order to obtain the increased gripping force for turning this type of screwdriver in both directions, the screwdriver handle is made so that the shank is removable and can be connected to either end of the handle. Further, at least one screwdriver has a handle in the shape of a ball to facilitate applying a high longitudinal force simultaneously with a high torque, with tool bit storage compartments inside of the ball. All of these individual solutions have disadvantages and drawbacks to one extent or another, such as inconvenience in use, bulky size, excessive manufacturing expense, etc.

Thus, there is a need for a compound turning tool which avoids the disadvantages and drawbacks of the prior art tools yet, which confines the advantages of those tools into a single tool which is convenient to use, is not bulky and which can be manufactured at a cost which is competitive with the cost of known turning tools.

BRIEF SUMMARY OF THE INVENTION

This invention relates generally to the field of hand tools and more particularly to a compound turning tool for turning a large variety of fastening devices.

The compound turning tool of the present invention combines into a single tool many of the advantages of prior art tools in which these advantages were present in separate tools, and yet avoids the disadvantages created by these prior art tools.

In one of its broader aspects, the principles of the present invention are embodied in a multi-purpose turning tool which has a handle adapted to be held in the hand of a user for simultaneously applying a turning force and a longitudinal force to the handle of the tool. The handle comprises two parts, a gripping member which is adapted to be surrounded by the fingers and a portion of the palm of a user's hand for applying the turning force, and a thrust plate which is rotatably connected to the gripping member in position to be pressed upon by the heel portion of the palm of the user's hand for applying the longitudinal force. A shank is connected to the gripping member for rotation therewith, the shank having a socket at the free end thereof, for receiving and holding one of a plurality of interchangeable tool bits.

In other aspects of the invention, the turning tool includes a directionally oriented gripping surface on the gripping member so that a greater turning force can be exerted by the user's fingers in one direction of rotation than in the other.

The gripping surface is defined generally by a plurality of outwardly projecting fingers which are formed integrally, as by molding, with an annular layer of rubber or rubber-like material, the fingers leaning or being angled, with respect to a radial line through the gripping member. Between each finger there is formed an abutment against which the fingers press where they are either depressed by a turning force in one direction being applied to the handle or raised or extended by a turning force in the opposite direction being applied to the handle. The abutments provide additional resistance to a reverse bending of the fingers so as to afford a greater resistance to slippage of the user's hand over the gripping surface than would otherwise be available.

The thrust plate is formed as a disc-like member and has a plurality of tool bit storage compartments formed therein for holding excess tool bits. The individual compartments extend in a longitudinal direction perpendicular to the direction of the gripping member which is elongate so that the compartments are open to a peripheral edge position of the disc-like member. The compartments are long enough to open at both ends to the peripheral edge position of the disc-like member so that tool bits can be inserted into and removed from the compartments at either end, preferably by being pushed by another tool bit. In the preferred embodiment of the invention, there is a thrust plate at each end of the gripping member, each plate with a central aperture through which the shank can be removably inserted into either end of the gripping member.

The tool bit receiving socket is provided with a magnetic holding device so that a tool bit properly sized can be very easily dropped into and removed from the socket. The arrangement is such that the magnetic field is directionally oriented to exert a maximum force on the tool bit and substantially no force in any other direction.

Thus, the present invention provides a multi-purpose turning tool which incorporates many of the advantages of prior art tools and yet avoids the disadvantages thereof. More specifically, the tool of the present invention functions as a multi-purpose tool by having a shank with a single socket which accents a plurality of interchangeable tool bits, eight of which can be stored at one time in the handle, thereby making the tool very economical to own and convenient to use and carry around since all of the tool bits are immediately accessible. The tool bits are very easy to insert into and remove from the socket since they are held in place only by magnetic force. Further, since the handle is generally cylindrical, it is not bulky and therefore takes up little space in a tool box or belt. Since the shank can be attached to either end of the handle in order to make full use of the directionally oriented gripping surface, expensive ratchet mechanisms can be avoided to keep the cost of the tool to a minimum. Of great importance is the advantage of utilizing the heel portion of the palm of the user's hand pressing on a rotatable thrust plate to apply strong longitudinal force to the tool while simultaneously applying strong turning force with the remainder of the palm and the fingers of the user's hand. By being able to grasp the handle in this fashion, the entire forearm can be utilized to provide the turning force rather than just the wrist, with the advantage that substantially more turning force can be applied without the user experiencing any wrist pain.

Having briefly described the general nature of the present invention, it is a principle object thereof to provide a multi-purpose turning tool which avoids the disadvantages of prior art tools and yet retains the advantages thereof and particular provides the advantages set forth above.

It is another object of the present advantage to provide a multi-purpose turning tool which is easy to use, is highly efficient, compact, lightweight and inexpensive to manufacture.

These and other objects, advantages and desirable features will become more apparent from an understanding of the following detailed description of a presently preferred embodiment of the present inventions when considered in conjunction with the accompanying drawings in which.

DETAILED DESCRIPTION OF THE INVENTION

Figure 1:
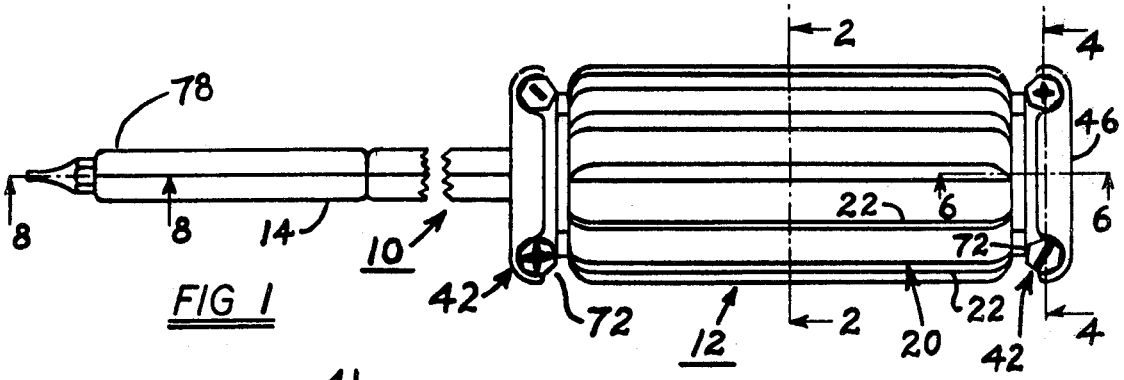
FIG. 1 is a longitudinal side view of a turning tool constructed in accordance with the principles of the present inventions.
Figure 2:
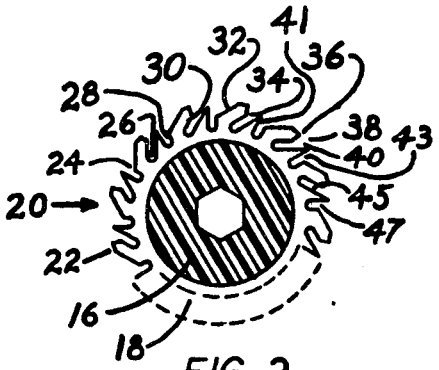
FIG. 2 is a sectional view through the handle taken on the line 2—2 of FIG. 1.

Referring now to the drawings, and particularly to FIGS. 1 and 2 thereof, there is seen a multi-purpose turning tool generally designated by the reference numeral 10, the tool having a handle generally designated by the reference numeral 12 and a shank generally designated by the reference numeral 14. The handle 12 comprises a core 16 formed of a suitable hard material such as aluminum or polycarbonate plastic and a resilient covering 18 formed of any of a variety of suitable rubber or rubber-like materials having the desired characteristics of flexibility, toughness and wearability the covering 18, as described below in more detail, provides a directionally oriented gripping surface generally designated by the reference numeral 20 which provides a greater resistance to slippage of the hand when a turning force is applied to the handle in one direction than in the other direction.

The directionally oriented gripping surface 20 is defined by a plurality of fingers 22 which are formed integrally with the covering 18 which has the configuration of an annular layer. As best seen in FIG. 2, each finger 22 is elongate and projects outwardly from the annular layer 18, but the longitudinal axis of each finger is disposed at an angle to a radial line extending through the finger. Stated differently, each finger "leans" in an angular direction, or is radially offset, with respect to a radial line from the center of the core through the finger. Each finger 22 has a base portion 24 which forms a juncture between the finger and the annular layer. The base portion 24 is bounded by the bottom of a first groove 26 on the side of the finger 22 toward which it is angled and a straight wall portion 28 on the opposite side. The finger 22 also has an intermediate portion 30 bounded by opposed wall portions 32 and 34 which extend outwardly, preferably with a small degree of convergence, each finger 22 being spaced from an adjacent finger by a distance approximately one half the thickness of the finger between the wall portions 32 and 34. Each finger 22 terminates in a tip portion 36 defined by sharply converging wall portions 38 and 40.

In between each finger 22 there is an abutment 41 which is defined by the aforementioned first groove 26 of which the aforementioned wall 34 is a side wall, and a second groove 43 of the aforementioned wall 38 is a side wall, the opposite side walls 45 and 47 of these grooves bounding the abutment 41. Each abutment 41 is also formed integrally with the covering 18 and are, therefore, of the same material. The abutments as shown in FIG. 2 are generally triangular and come to a point, although this specific configuration is not critical to the invention.

From the foregoing description, it will be apparent that when a user grasps the handle 12 with his hand, either by encirling the handle 12 with his fingers and part of his palm or by completely encircling the handle 12 with his hand, the fingers 22 will immediately be depressed in the direction in which they lean or are angled. If a turning force is applied to the handle 12 in the direction in which the fingers are angled, the fingers depress inwardly toward the layer 18 and ultimately press on the abutment 41, at which point the depressed fingers 22 are lying in a substantially tangential orientation with respect to the layer 18. In their orientation, a relatively small amount of resistance to slippage by the user's hand is offered by the fingers 22, and the more turning force that is applied in this direction, the more the fingers will depress to present an almost smoothe surface over which the user's hand will slip.

If, however, a turning force is applied to the handle in the opposite direction, the fingers 22 will tend to rise and extend outwardly toward a true radian orientation and even beyond until the fingers 22 contact the abutment 41 bending in the reverse direction. Even before the fingers touch the abutment 41, the outwardly extending tip 36 of each finger 22 will offer considerable resistance to slippage of the user's hand so that the user can exert considerable turning force to the handle. As additional turning force in this direction is applied, the fingers 22 contact and start to depress the abutments 41 with the result that the abutments 41 offer resistance to further bending of the fingers 22 in this direction. Thus, the raised fingers 22 offer great resistance to slippage of the user's hand so that he can exert a large turning force to the handle 12. The outer end or tips 36 of the fingers literally dip into the fingers and palm portion of the user's hand so that a surprisingly large turning force can be applied to the handle 12.

Figure 3:
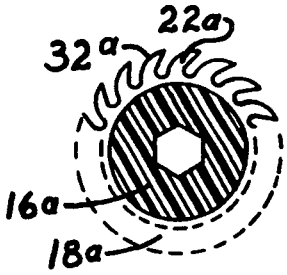
FIG. 3 is a view similar to FIG. 2 of an alternate form of gripping surface.
Figure 5:
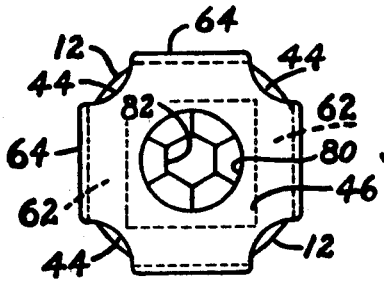
FIG. 5 is an end view of the turning tool shown in FIG. 1.

FIG. 3 shows another embodiment of a handle 12 in which there are no abutments between the fingers **22*a* which are generally curved on the outer surface 32*a* rather than straight. Otherwise, these fingers are substantially the same as the fingers shown in FIG. 2** and function generally in the same manner.

Figure 6:
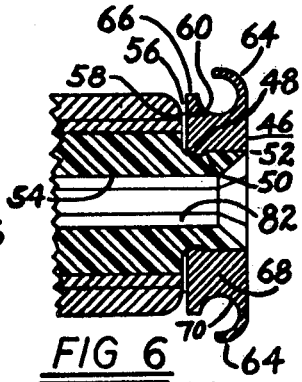
FIG. 6 is a fragmentary sectional view taken on the line 6—6 of FIG. 1.
Figure 9:
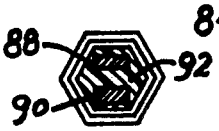
FIG. 9 is an end view of the socket shown in FIG. 8.
Figure 8:
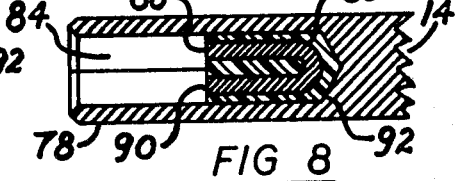
FIG. 8 is a fragmentary sectional view on an enlarged scale taken on the line 8—8 of FIG. 1 showing the socket end of the turning tool.

As briefly mentioned above, it is necessary, especially when turning relatively large fastening devices which offer considerable resistance to turning, to apply a very substantial longitudinal force to the turning tool while simultaneously applying the turning force in order to assure that the tool bit engaged with the fastening device does not slip and become disengaged. This is a common problem with screwdrivers and like turning tools and causes great inconvenience and occasionally even injury to the user's hands. To achieve the longitudinal force most effectively, the handle 12 is provided with a thrust plate generally indicated by the reference numeral 42. The thrust plate 42 comprises a disc-like member rotatably mounted on the end of the handle 12, and is the preferred embodiment of the invention. There is a thrust plate mounted on both ends of the handle 12. As best seen in FIGS. 4 through 7, the thrust plate can be either generally square or six sided for a purpose to be made clear hereinbelow, although it is not limited to these shapes. It is approximately the same width as the handle 12. The thrust plate has peripheral edge portions 44 and a front surface 46 adapted to be pressed by the heel portion of the palm of a user's hand. The thrust plate also has an annular ridge 40 which is forcibly pressed into an annular set back 50 formed in the exterior surface 52 of an annulus 54 which extends longitudinally outwardly from the core 16 of the handle 12. A suitable flat bearing such as a Teflon washer 56 is placed on the handle 12 before the thrust plate is pressed on so that the washer 56 acts as a clearing between the mating pressure surfaces 58 and 60 on the thrust plate 42 and the core 16 respectively, thereby permitting the thrust plate 42 to rotate freely on the handle 12 even when a high longitudinal pressure is applied to the thrust plate 42. As best seen in FIG. 6, the thrust plate 42 is made thick enough so that the outer surface 46 thereof is in a plane just outwardly of the plane in which the outer edge 68 of the annulus 54 lies. The purpose of this is to minimize the resistance to turning the thrust plate by the heel of the user's palm pressing on the non-rotatable outer edge of the handle 12.

Figure 4:
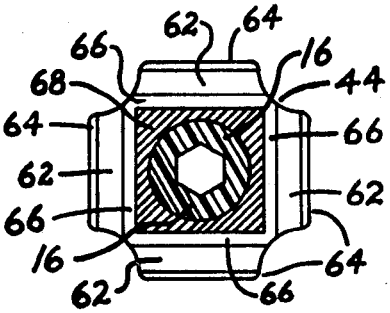
FIG. 4 is a sectional view through a thrust plate taken on the line 4—4 of FIG. 1.
Figure 10:
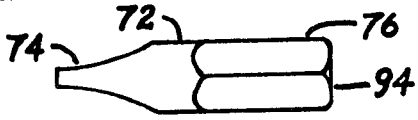
FIG. 10 is a side view of a typical tool bit used with the turning tool.

Referring now to FIGS. 4 and 6, it will be seen that each thrust plate 42 is provided with a plurality of tool bit storage compartments so that all of the interchangeable tool bits customarily used with the tool 10 are immediately accessible when and where they are needed. The thrust plate 42 is provided with four such compartments 62 (see FIG. 4) each compartment being defined by a curved wall 64 which extends from the flat outer wall 46 of the thrust plate 42 to a point spaced from an inner edge 66 which extends around the four sides of the thrust plate. The curved wall 64, together with an annular body portion 68 of the thrust plate define an inner partially circular wall 70 which defines the storage compartment 62. The reason for the wall 64 terminating in spaced relationship with the edge 66 is to provide a resilient holding force to a tool bit 72 (see FIG. 1) which is slightly larger than the diameter of the storage compartment 62. FIG. 10 shows a typical tool bit 72 which has a specially shaped end 74 to engage with a fastening device and usually square or hexogonally shaped end 76 which is received within a socket 78 formed on the free end of the shank 80.

The length of the tool bits 72 and the size of the thrust plate 42 are dimensionally related such that the tool bits 72 are of approximately the same length as the storage compartments 62. The storage compartments 62 in turn are long enough to be open at both ends to the edge portions 44 so that tool bits can be inserted and removed from the compartments 62 from either end. Typically, a tool bit is removed from a compartment by inserting another tool bit from one end so as to push the stored tool bit out of the compartment from the other end.

Figure 7:
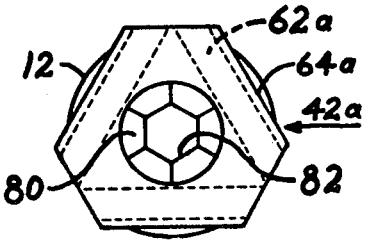
FIG. 7 is a view similar to FIG. 5 showing an alternate form of thrust plate.

FIG. 7 shows another embodiment of the thrust plate, this plate 42a, being six sided with a tool bit storage compartment 62a, extending along each of three long edges defined by curved walls 64a. Other than the configuration of the thrust plate as shown and the fact that it has three storage compartments rather than four, it is structurally identical to the thrust plate 42. Both forms of thrust plates have central apertures 80 and 80a, respectively through which the shank 14 can be inserted in a hexagonal socket 82 formed in both ends of the handle 12.

Another feature of the present invention is the manner in which the tool bits 72 are retained in the socket 78 includes a hexagonally shaped chamber 84 for receiving the correspondingly shaped end 76 of the tool bit 72. A horseshoe shaped magnet 86 having a north pole 88 and a south pole 90 is embedded in a block of suitable insulating material 92 which is affixed within the chamber 84 at a depth such that when the tool bit 72 is inserted into the socket 78, the rear face 94 of the tool bit abuts the ends of the magnet with just a small portion of the tool bit protruding from the end of the socket 78, as seen in FIG. 1. Because of the shape of the magnet and the surrounding insulating material 92, the magnetic is highly directional in that a relatively strong magnetic force is directed outwardly along the axial direction of the shank 14 and socket 78 in order to hold the tool bit securely, but substantially no magnetic force is directed either in the opposite axial direction or in any radial direction. With this construction, the tool bit can be easily inserted and removed from the socket and yet is securely held in place during use,

I claim:

1. A multi-purpose turning tool comprising:

A. a handle adapted to be held in the hand of a user for simultaneously applying a longitudinal force and a turning force to the tool, said handle comprising 1. a gripping member adapted to be surrounded by the fingers and a portion of the palm of a user's hand for applying said turning force, said gripping member being generally elongate, and
2. a thrust plate rotatably connected to said gripping member in position to be pressed upon by the heel portion of the palm of the user's hand for applying said longitudinal force, said thrust plate being formed as a disc-like member rotatably connected to one end of said gripping member and including a plurality of tool bit storage compartments formed therein for holding excess tool bits, and B. a shank connected to said gripping member for rotation with said gripping member, said shank being connected to the other end of said gripping member and having a socket at the free end thereof for receiving and holding one of a plurality of interchangeable tool bits.

2. A multi-purpose turning tool as set forth in claim 1 wherein said tool storage compartments are formed in said thrust plate in a longitudinal direction perpendicular to the longitudinal direction of said gripping member and therefore are open to a peripheral edge portion of said disc-like member.

3. A multi-purpose turning tool as set forth in claim 2 wherein each tool bit storage compartment is long enough to open at both ends to said peripheral edge so that tool bits can be inserted into and removed from said storage compartments from either end thereof.

4. A multi-purpose turning tool as set forth in claim 1 wherein

A. said gripping member includes means at both ends for removably connecting said shank to said gripping member, and B. there is a thrust plate rotatably connected to both ends of said gripping member, each thrust plate having a central aperture through which said shank is inserted to connect said shank to either end of said gripping member.

5. A multi-purpose turning tool as set forth in claim 4 wherein said plurality of tool storage compartments are disposed in said thrust plate around the periphery thereof and surrounding said central aperture.

6. A multi-purpose turning tool comprising:

A. a handle adapted to be held in the hand of a user for applying a turning force to the tool, said handle comprising 1. and elongate core formed of a relatively hard material,
2. an annular layer of resilient material extending around said core, and
3. means defining a directionally oriented gripping surface formed integrally with, and of the same material as, said annular layer, and B. a shank connected to said gripping member for rotation therewith, said shank having a socket at the free end thereof for receiving and holding one of a plurality of interchangeable tool bits, and C. wherein said means defining said directionally oriented gripping surface comprises a plurality of outwardly projecting fingers formed integrally with said annular layer, said fingers being angled with respect to a radial line through said gripping member, whereby a greater gripping force can be applied to said gripping member by the user's hand in one direction of turning force than in the other direction.

7. A turning tool as set forth in claim 6 wherein said fingers are elongate and extend substantially the entire length of said gripping member.

8. A turning tool as set forth in claim 6 wherein said means defining said directionally oriented gripping surface further comprises a plurality of outwardly projecting abutment members formed integrally with said annular layer, one of said abutment members being disposed between each pair of adjacent fingers whereby said fingers press against said abutment members when said fingers are bent in a direction opposite to the direction in which the fingers are angled so as to resist further bending of said fingers.

* * * * *